US006273066B1

(12) United States Patent
Fränkle et al.

(10) Patent No.: US 6,273,066 B1
(45) Date of Patent: Aug. 14, 2001

(54) FUEL INJECTION FOR AN INTERNAL COMBUSTION ENGINE

(75) Inventors: Gerhard Fränkle, Remshalden-Grunbach; Volker Schwarz, Weinstadt, both of (DE)

(73) Assignee: DaimlerChrysler AG (DE)

( * ) Notice: Subject to any disclaimer, the term of this patent is extended or adjusted under 35 U.S.C. 154(b) by 0 days.

(21) Appl. No.: 09/558,833

(22) Filed: Apr. 26, 2000

(30) Foreign Application Priority Data

May 12, 1999 (DE) ..... 199 21 878

(51) Int. Cl.[7] ..... F02M 37/04
(52) U.S. Cl. ..... 123/446; 123/496; 123/506
(58) Field of Search ..... 123/446, 447, 123/506, 496, 467; 239/88–96

(56) References Cited

U.S. PATENT DOCUMENTS

| | | | | |
|---|---|---|---|---|
| 4,250,857 | * | 2/1981 | Taplin | 123/496 |
| 4,627,403 | | 12/1986 | Matsumura | 123/447 |
| 5,619,969 | * | 4/1997 | Liu et al. | 123/447 |
| 5,694,903 | * | 12/1997 | Ganser | 123/496 |
| 5,711,277 | * | 1/1998 | Fuseya | 123/496 |
| 5,890,471 | * | 4/1999 | Nshimura | 123/496 |

FOREIGN PATENT DOCUMENTS

| | | |
|---|---|---|
| 196 17 738 A1 | 3/1996 | (DE) . |
| 196 19 523 A1 | 5/1996 | (DE) . |
| 0080218967 AA | 4/1995 | (JP) . |

* cited by examiner

*Primary Examiner*—Thomas N. Moulis
(74) *Attorney, Agent, or Firm*—Mark P. Calcaterra

(57) ABSTRACT

A fuel injection system for an internal combustion engine with a reservoir for pressurised fuel and at least one fuel injector which has a solenoid activated valve to control fuel pressure therein, and including a control piston linked to the injector's valving member and defining a control space communicated with the injector's fuel, and further including a pressure regulating valve assembly with another solenoid activated valve operated independently of the injector's solenoid valve and which is located between the reservoir and the fuel injector for selectively creating different flow control configurations to regulate fuel pressure delivered to the injector. The two solenoid activated devices providing an injector control for providing flexible opening operation of the injector at more than one fuel pressure level.

5 Claims, 4 Drawing Sheets

FUEL INJECTION FOR AN INTERNAL COMBUSTION ENGINE

CROSS REFERENCE TO RELATED APPLICATIONS

Priority is claimed under 35 U.S.C. 119 with respect to German Patent Application 199 21 878.1–13 filed on May 12, 1999.

BACKGROUND OF THE INVENTION

1. Field of Invention

The invention relates to a fuel injection system for an internal combustion engine with a high-pressure pump for pumping the fuel into a high-pressure reservoir and with at least one injector connected to the high-pressure reservoir by a feed line. Operation of the fuel injector is controlled by a solenoid valve with fuel passages which are connected to the feed line, one of the fuel passages leads to an injection nozzle and another fuel passage leads to a control space which is delimited by a control piston interacting with a nozzle needle of the injection nozzle and which is connected to a low pressure return past a solenoid valve which controls the injector. Furthermore a pressure regulating valve is provided in the path of fuel flow between the high-pressure reservoir and the injection nozzle and has a passage used to direct fuel flow from the high-pressure reservoir to the injection nozzle.

2. Description of Related Art

DE 196 12 738 A1 has disclosed a fuel injection system of this general type with an injector controlled by a solenoid valve. The injector contains a pressure control valve which is combined with the control piston and controls the flow connection between the high-pressure reservoir and the injection nozzle in a manner dependent on the solenoid valve, such that the flow connection is interrupted between the injection processes but opened up during each injection process.

In this prior art embodiment, the fuel feed passage leading to the pressure space about the nozzle and needle valve is always connected to a restricted return line located on the low-pressure side. Before the start of an injection, only a very low pressure acts on the needle seat of the injection nozzle. As soon as the connection between the high-pressure reservoir and the needle seat is established, the pressure at the needle seat rises. Once the opening pressure of the injection nozzle is exceeded, injection starts. To end injection, the flow connection between the high-pressure reservoir and the needle seat is again closed and the pressure at the nozzle needle of the injection nozzle decreases rapidly. Once the pressure falls below the injector valve's opening pressure, the injection nozzle closes.

In reservoir-type injection systems of this kind, the operation of the nozzle needle is controlled in its stroke motion by fuel pressure. Accordingly, desirable subsequent post-injections, which contribute to reducing soot formation, are not readily carried out.

SUMMARY OF THE INVENTION

The main object of the invention is to provide regulation and control of a fuel injection system which, in addition to post-injection, also make it possible to influence the opening of the injection valve at different pressures.

By virtue of the controls implemented on the subject fuel injection system, the high pressure of the reservoir effectively operates ahead of the injector's needle seat even after the closing of the first solenoid valve, which is arranged to control the connection between the control space and the low pressure fuel return. This makes it possible to achieve a subsequent post-injection under influence of high injection pressure.

Another advantageous feature of the invention results from providing opening control of the injector's nozzle needle as initiated by activating the first solenoid valve, irrespective of the particular fuel pressure value.

It is furthermore possible to provide a solenoid valve in the role of damage preventer for the pressure control valve since a faulty injector can be separated from the high-pressure system by activating a second solenoid valve.

Furthermore, a pilot injection can be carried out by means of a restricted pressure connection located in an intermediate position between the second and the third operative positions of a pressure regulating and control piston.

Another advantage is the possibility of selecting the position of the pressure regulating valve by a solenoid activated valve, which is used either as a component integrated into the injector or as a retrofitted kit inserted into an exposed feed line.

BRIEF DESCRIPTION OF THE DRAWINGS

The fuel reservoir system according to the invention is illustrated in the drawings. In the drawing.

DESCRIPTION OF THE PREFERRED EMBODIMENT

Figure 1:
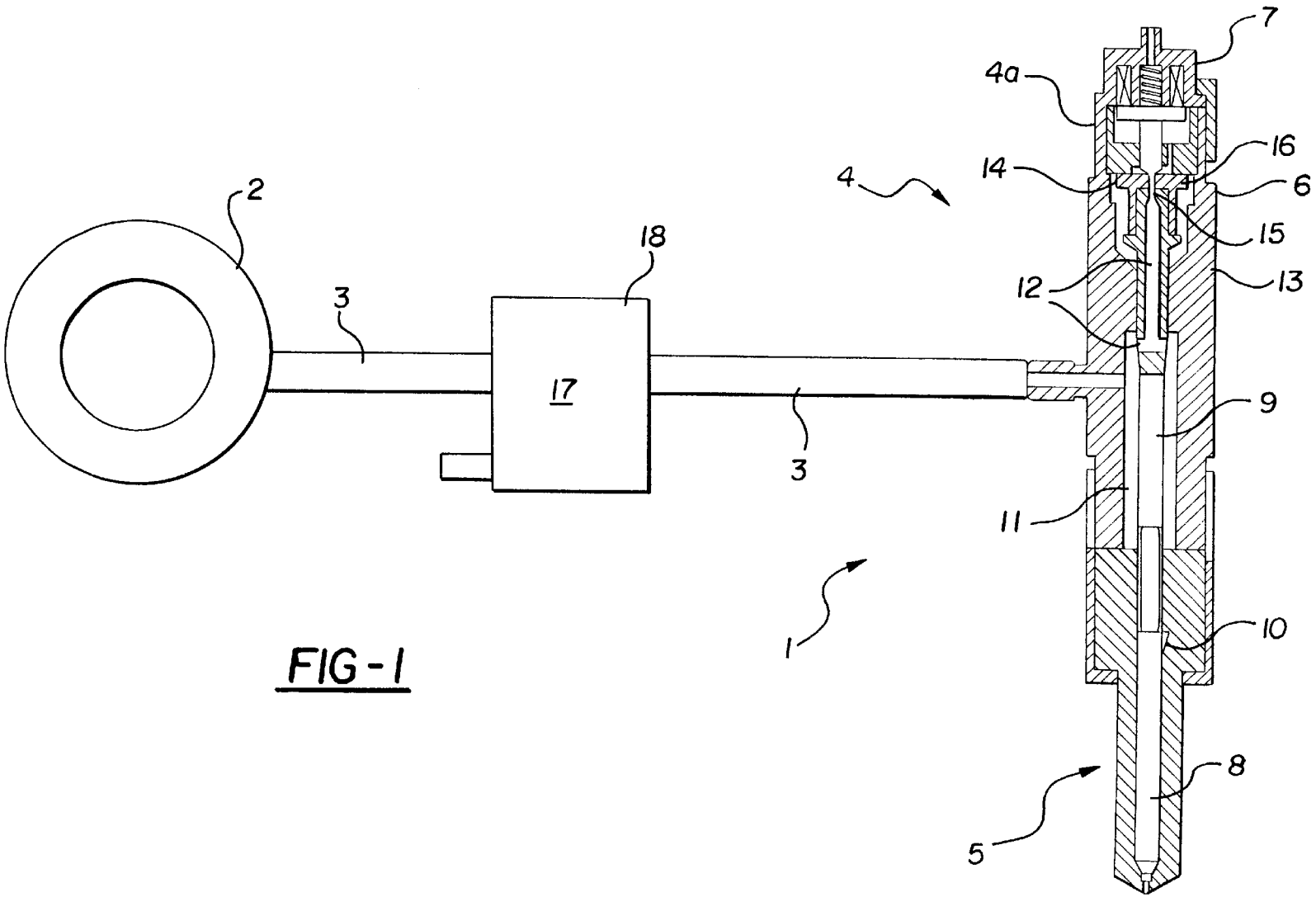
FIG. 1. shows a fuel injection system with a pressure regulating valve provided in the fuel feed line which includes a solenoid activated valve.

A fuel injection system 1 is shown in FIG. 1 comprising a high-pressure reservoir 2, a fuel feed line 3, and a fuel injector 4. Injector 4 has an injection nozzle 5, a spring-loaded control piston 6, and a solenoid valve 7 which is supported on a head section 4*a* of the fuel injector 4.

The fuel injection nozzle 5 incorporates a nozzle needle 8 which interacts via a push rod 9 with a control piston 6. The nozzle needle 8 is surrounded by an annular pressure chamber 10 which is connected to a fuel passage 11 which itself is connected to the fuel feed line 3. A further fuel passage 12 in the housing 13 of the injector leads away from the feed line then through a passage in the push rod 9 and finally into a control space 14 delimited by the control piston 16. Adjacent to the control-space end of push rod 9, the fuel passage 12 has an orifice or restrictor 15. The cup shaped control piston 6 provides an orifice or restrictor hole 16 which is substantially coaxial with the orifice or restrictor 15. The injector 4 is of the type which is opened by fuel pressure as opposed to electrically opened fuel injectors.

A pressure regulating valve assembly 17 is arranged in the feed line 3 between the high-pressure reservoir 2 and the injector 4. Valve 17 supports a solenoid activated valve at one end portion of a valve housing 18. Housing 18 has a cylindrical location hole 19 in which a pressure regulating piston 20 is supported. Piston 20 is guided in a longitudinally displaceable manner in the hole 19.

Figure 2:
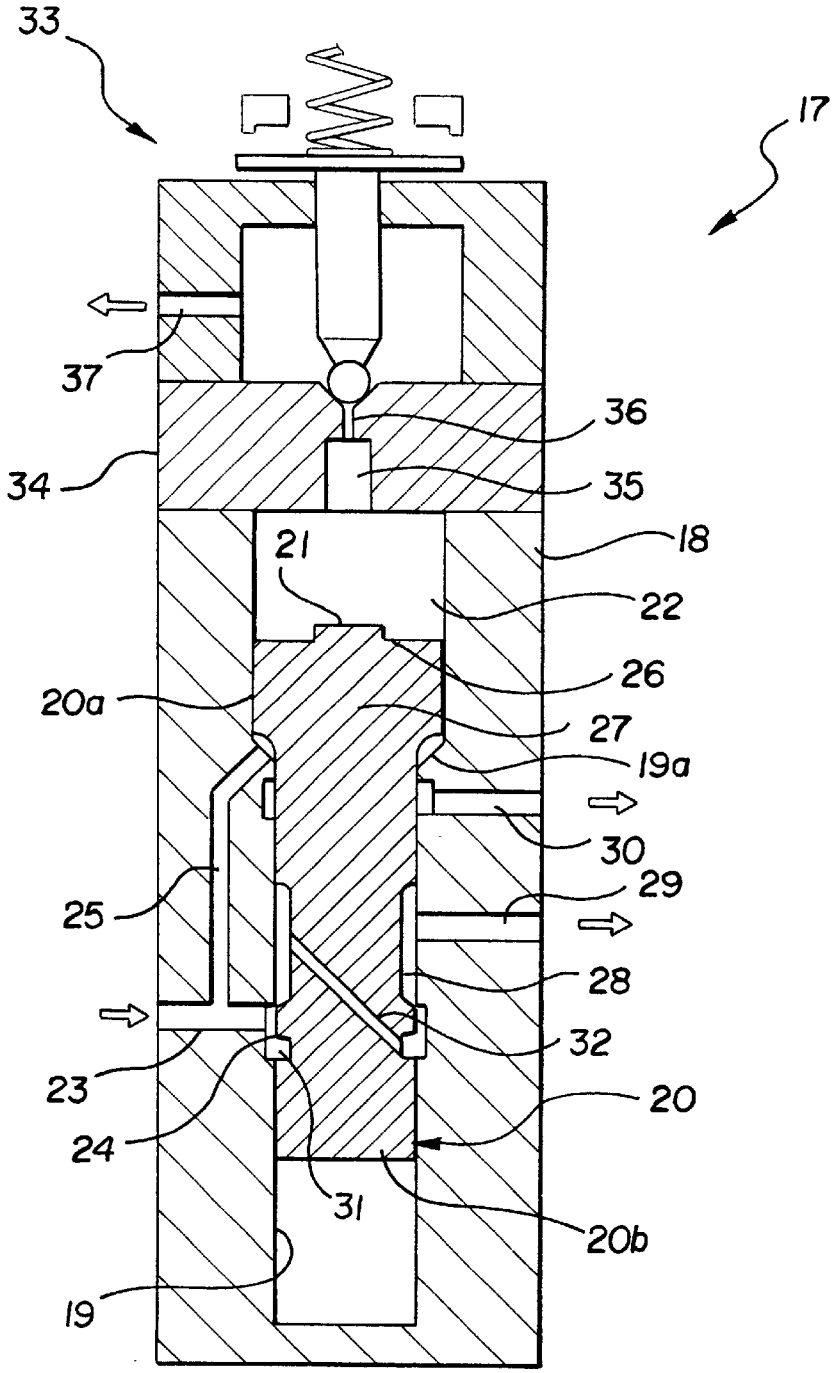
FIG. 2 shows an elevational sectioned view of the pressure regulating valve.
Figure 3A:
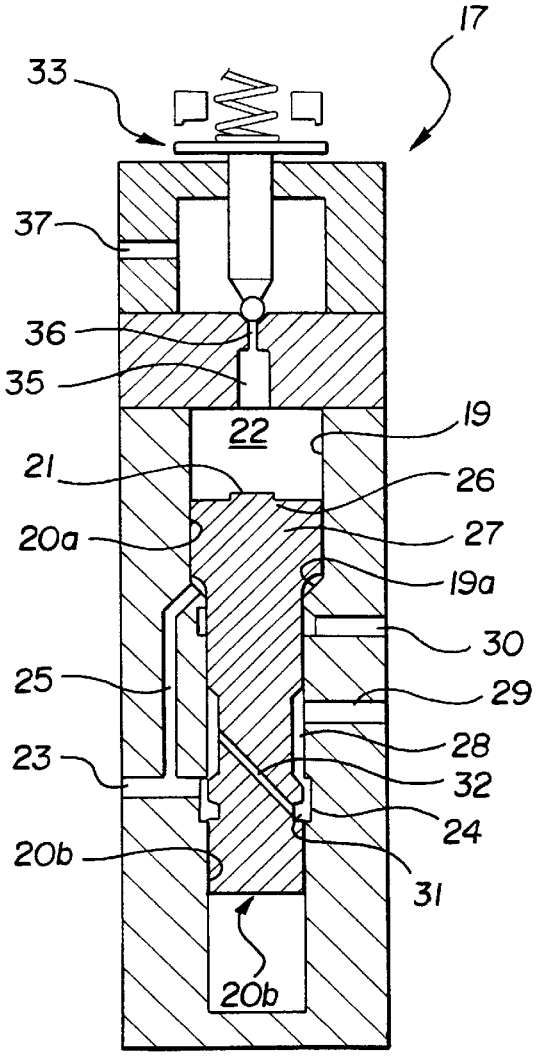
FIGS. 3*a–d* show elevational sectioned views of the pressure regulating valve with its pressure regulation piston in four different operational positions.

The configuration of the pressure regulating piston 20 is a stepped design with a radially enlarged upper piston portion 20*a* with a centrally situated protrusion 21 projecting into a pressure control space 22 at the end of the piston 20. The location hole 19 is of similarly of stepped design and configured with a shoulder or step portion 19*a* serving as a stop for the enlarged portion 20*a* of the piston 20 thus maintaining it in its initial position (FIGS. 2, 3*a*, 3*d*).

In valve housing 18 a radial or transverse hole 23 is provided and connects, on one end, to the feed line 3 coming from the high-pressure reservoir 2 and, on the other end, with a circumferential groove 24, which is machined into the wall of the housing 18 near location hole 19. The width of groove 24 is approximately twice the diameter of the transverse hole 23. Also in housing 18, a passage 25 branches off from the transverse hole 23 and leads to the region adjacent step portion 19*a*. A connecting hole 27 runs through the enlarged portion 20*a* of piston 20 and connects the passage 25 to the pressure control space 22. An inlet restrictor or orifice 26 is provided in hole 27.

The lower portion 20*b* of piston 20 is of reduced diameter and has an annular groove 28 formed therein. Groove 28 has a width which is significantly greater than the width of the circumferential groove 24 in housing 18. In the pressure-relief operative position of the piston 20 shown in accordance with FIG. 3*b*, groove 28 overlaps both an outlet passage 29 leading to the injector 4 and a fuel return passage 30 leading to a to a tank (not shown). The passage 30 is located a slight distance above outlet passage 29. This positioning arrangement creates a connection for fuel flow from injector 4 back to the tank return passage 30.

A second annular groove 31 is formed in the reduced lower portion 20*b* of piston 20. Groove 31 overlaps the lower half-portion of the circumferential groove 24 when the valve 20 is in its initial operative position (FIG. 3*a*) and the large annular groove 28 overlaps an upper region of the circumferential groove 24. A diagonal hole 32 in the piston 20 connects the axially spaced-apart grooves 28 and 31. The hole 32 acts as a flow control restrictor for any pressure build-up which might occur during phase III in accordance with the positioning as shown FIG. 3*c*.

The pressure regulating valve 17 is associated with a solenoid valve assembly 33 which includes a low-pressure outflow connection extending from the pressure regulating space 22 to a return passage 37. The outflow includes a bleed hole 35 arranged in an intermediate housing part 34 and a restrictor or orifice 36 is formed to control flow volume. Opening and closing of bleed hole 35 is accomplished by movement of a ball tipped valving element which is actuated by solenoid assembly 33 as understood by referring to FIGS. 3*a*–3*d*.

The various operating phases of the pressure regulator 17 will be explained with reference to the exemplary embodiment as shown in FIGS. 3*a* to 3*d:*

FIG. 3*a* shows an initial operative position of valve 20 corresponding to a pause-in injection. The solenoid valve 33 is in a deactivated state and thus bleed hole 35 is closed. By alignment of grooves 24, 28, and 31, an unrestricted pressure connection is established between reservoir 2 and injector 4 as seen in FIG. 3*a*. In the associated injector 4, the solenoid valve 7 maintains the drain restrictor or passage 16 closed from control space 14 at the injector's upper end portion.

The high-pressure reservoir 2 is designed as a common fuel rail for more than one injector and is connected to all the injectors by feed lines.

Figure 3B:
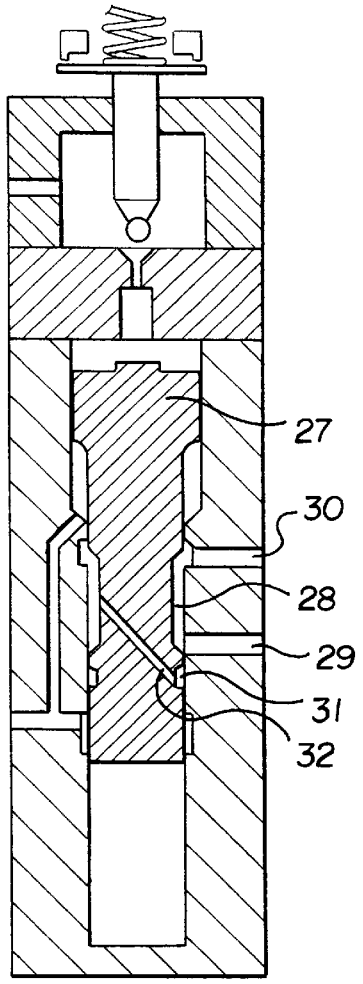

A phase II operative positioning before actual injection begins is illustrated in FIG. 3*b* in which solenoid valve 33 of the valve 20 is activated to open passage 35 and restrictor 36 which communicates the pressure control space 22 with the return passage 37 to drain space 22 and reduce the fuel pressure therein. The fluid pressure forces tend to move the piston 20 to the more upward operative position shown in FIG. 3*b*. This positioning provides a flow connection via the large annular groove 28 on the piston 20 between injector 4 by passage 29 and the return passage 30 leading to the tank. At the same time, the positioning of the piston 20 interrupts the connection between the high-pressure reservoir 2 and the injector 4. As a result, the pressure in the region between the pressure control valve 20 and the needle seat of the injector 4 decreases to the return pressure level so that valve 8 is seated in a closed operative position.

Figure 3C:
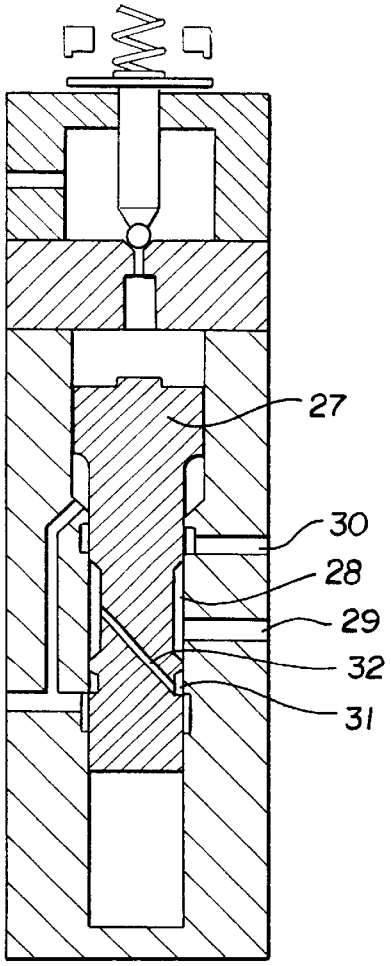
Figure 3D:
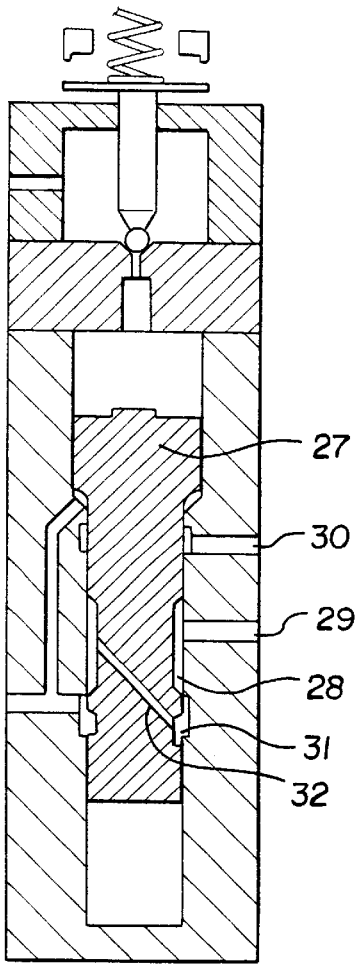

An intermediate phase III of operation is shown in FIG. 3*c*, occurring before the desired start of injection wherein the connection is closed between passages 29 and 30 or from injector 4 to the return and, at the same time, the connection between the high-pressure reservoir 2 and the injector 4 is reopened, initially with only flow through a relatively small area or cross section provided by means of a small overlap between the radial or transverse passage 23 and the small annular groove 31 in the piston 20 and by means of diagonal hole 32 acting as a flow restrictor. As a result of this relatively restricted connection, the pressure adjacent the seat of nozzle needle 8 of the injector increases slowly as demonstrated in FIG. 4.

Figure 4:
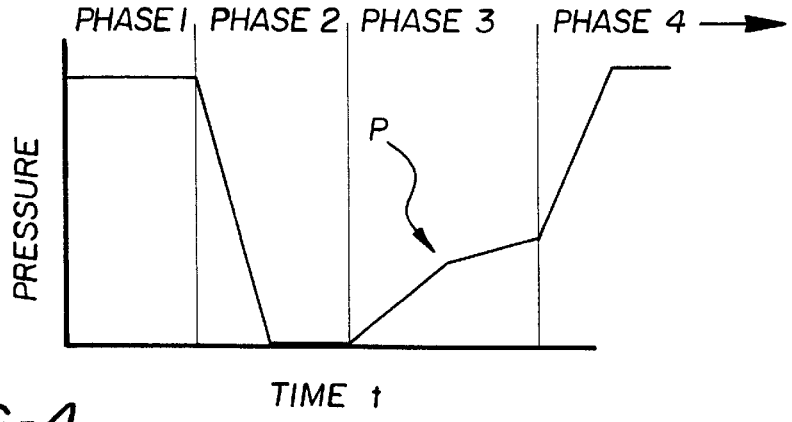
FIG. 4 shows a plot of a variation in pressure with time for system operation and revealing four phases of operation.

In the subject system, initiation of fuel injection is by activating solenoid valve 7 of injector 4 at a desired fuel pressure such as at pressure value p in FIG. 4. After a short period, an unrestricted pressure connection is established between reservoir 2 and injector 4 by the downward positioning of the valve 20 as illustrated in FIG. 3*d* where a phase IV of operations is revealed corresponding to the plot in FIG. 4. Resultantly, the fuel pressure adjacent nozzle needle 8 is increased to the reservoir of rail pressure level. The termination of injection is by deactivation of the injector's solenoid valve 7. Subsequent to the termination of injection, the relatively great fuel pressure effectively remains adjacent to the nozzle needle 8. This availability of pressurised fuel readily permits a latter implementation of a high-pressure post-injection.

During the phase III operation in accordance with the positioning shown in FIG. 3*c*, it is also possible to vary the duration of the restricted flow connection by pulsing solenoid valve 33 which will influence the shape of the injection pressure trace as seen in FIG. 4. This same effect can also be achieved by means of a variable sized restrictor in the bleed passage 35 such as could function on the basis of movement of a magnet in stages or even by using a piezoelectric actuator (neither construction shown).

What is claimed is:

1. In a fuel injection system for an internal combustion engine having a high-pressure pump for pumping fuel into a fuel reservoir and having at least one fuel injector connected to the reservoir by a feed line, the fuel injector having an injection nozzle and a movable nozzle needle therein to control flow therethrough and being fluidly connected to the feed line, a control piston in the fuel injector defining a control space at one end thereof fluidly connected to the feed line, the injection needle and control piston being operatively connected, a fuel bleed passage connected to the injector's control space, and a solenoid activated valve co-operative with the fuel bleed passage to selectively transmit pressurised fuel from the control space to a low-pressure fuel return when the bleed passage is opened, and further including a fuel inlet pressure regulating valve assembly between the reservoir and fuel injection to selectively vary the cross section of the flow connection from the reservoir to the injector for regulating fuel flow thereto, characterised in that: the pressure regulating valve assembly has a pressure regulating valve (20) movable in response to fuel pressure and a solenoid valve (33) adjacent one end of the pressure regulating valve (20) and which is operated independently of the injector's solenoid valve; the solenoid valve (33) being controlled to effect movements of said pressure regulating valve (20) which varies the cross section of the fuel passage from the reservoir to the injector in a way establishing a first position of the pressure regulating valve (20) corresponding to an injection phase when the solenoid valve (33) is closed during which a flow connection from the reservoir to the injector (4) is open, and a second position of the pressure regulating valve (20) corresponding to a phase just before an injection when the solenoid valve (33) is opened during which the flow connection from the reservoir to the injector (4) is closed but a flow connection from the injector (4) to a low-pressure side of the pump is open, and a third position of said pressure regulating valve (20) corresponding to a phase just prior to the start of injection when the solenoid valve (33) is closed during which the flow connection from the reservoir to the injector (4) is opened in coordination with opening of the injector's solenoid valve (7).

2. The fuel injection system according to claim 1, in which the pressure regulating piston (20) of the valve assembly (17) is guided in a longitudinally displaceable manner within a cylinder location hole (19) in a valve housing (18) and the piston (20) contains a connecting hole (27) with a flow restrictor (26) therein for connecting the reservoir (2) continuously with the pressure control space (22) as defined by the end portion of the pressure regulating piston (20).

3. Fuel injection system according to claim 1 or 2, in which the pressure regulating piston (20) has formed on its outer circumference spaced-apart annular grooves (28, 31) which are continuously connected to one another by a hole (32) running through the pressure regulating piston (20) and acting to restrict flow therebetween so that with the solenoid valve (33) opened a flow connection is opened between the injector (4) and the pump's inlet side.

4. Fuel injection system according to claim 3, in which the pressure regulating piston (20) has a stepped configuration and the corresponding cylindrical location hole (19) has a similarly stepped configuration, the stepped configuration of the cylindrical location hole (19) forming a shoulder acting as a stop for the pressure regulating piston (20) in one of its operative positions.

5. Fuel injection valve according to claim 4, in which a circumferential groove (24) is formed in the cylindrical location hole (19) and being connected to the feed line (3) by means of which a partial overlap is established with the smaller annular groove (31) in the pressure regulating piston (20) preparatory to a start of an injection phase and subsequently a more complete overlap between the grooves (24 and 31) and a narrow overlapping between the groove (24) and the annular groove (28) is provided during an initial operative position of the pressure regulating valve (20).

* * * * *